US006065273A

United States Patent [19]

Schneider

[11] Patent Number: 6,065,273

[45] Date of Patent: May 23, 2000

[54] CONTOURED ENGLISH SADDLE PAD HAVING EXHIBITOR NUMBER DISPLAY

[75] Inventor: Donald P. Schneider, Chesterland, Ohio

[73] Assignee: Schneiders Saddlery Co., Inc., Chagrin Falls, Ohio

[21] Appl. No.: 09/219,678

[22] Filed: Dec. 23, 1998

[51] Int. Cl.[7] ..... B68C 1/12

[52] U.S. Cl. ..... 54/66

[58] Field of Search ..... 54/44.1, 44.5, 54/44.7, 66

[56] References Cited

U.S. PATENT DOCUMENTS

| | | | |
|---|---|---|---|
| 1,926,420 | 9/1933 | Renfro | 54/44.1 |
| 3,466,852 | 9/1969 | Stoner | 54/44.1 |
| 3,719,024 | 3/1973 | Searl | 54/44.1 |
| 4,524,570 | 6/1985 | Racinet | 54/44 |
| 4,716,715 | 1/1988 | Johnson | 54/44 |
| 4,879,865 | 11/1989 | Van Scoyk | 54/44 |
| 5,027,589 | 7/1991 | Gleb et al. | 54/66 |
| 5,062,256 | 11/1991 | Kingett et al. | 54/78 |
| 5,426,925 | 6/1995 | Smargiassi | 54/79.1 |
| 5,555,710 | 9/1996 | Smith . | |
| 5,575,139 | 11/1996 | Green | 54/66 |
| 5,768,864 | 6/1998 | Chang | 54/23 |
| 5,782,070 | 7/1998 | Knight et al. | 54/66 |
| 5,802,823 | 9/1998 | Woods | 54/66 |
| 5,901,532 | 5/1999 | Bopp | 54/66 |

FOREIGN PATENT DOCUMENTS

| | | | |
|---|---|---|---|
| 364933 | 3/1939 | Italy | 54/44 |

OTHER PUBLICATIONS

AQHA Official Handbook Jan. 1, 1999 47th Edition.

Joseph Sterling—English Saddles p. 12, 17, 36 & Index.

1997–98 Annual Catalog Schneiders.

American Quarter Horse Association Official Handbook of Rules & Regulations, Jan. 1, 1999, pp. 190–193: 464. Hunter Under Saddle.

Schneiders Saddlery Co., Inc. 1997–98 Annual Catalog #150, 8255 E. Washington St., Chagrin Falls, OH 44023, pp. 12, 16, 17, 36.

*Primary Examiner*—Thomas Price

*Attorney, Agent, or Firm*—Jones, Day, Reavis & Pogue

[57] ABSTRACT

The invention provides a contour English saddle pad having a rear area that is sufficient in size to accommodate an exhibitor number on each side of the pad. Preferably, the rear area of each side of the pad comprises a transparent or translucent, preferably non-glare plastic pocket, into which a card printed with the exhibitor number may be easily inserted and removed. The saddle pad of the invention allows display of the exhibitor number on each side of the horse without detracting from the presentation of the horse and is especially useful in English classes in which conformation is a judging criteria. A major benefit of the saddle pad of the invention, especially in English classes in which multiple horses are exhibited simultaneously, is that the exhibitor's number is continuously displayed within the same field of vision in which the judge evaluates the movement and conformation of the horse, thereby eliminating viewing problems associated with the traditional wearing of the exhibitor number on the rider's back.

9 Claims, 4 Drawing Sheets

CONTOURED ENGLISH SADDLE PAD HAVING EXHIBITOR NUMBER DISPLAY

BACKGROUND OF THE INVENTION

Contestants at horse shows receive exhibitor numbers when their entries are processed, to identify each horse entered in the show. The contestant displays the appropriate number in each class in which the particular horse exhibits. When judging (placing) the contestants, the judges make their selections by noting the exhibitor numbers on their judging cards.

The exhibitor numbers are typically printed on or otherwise attached (such as by printing on sticky paper) to a card which may be made from, for example, heavy paper or cardboard, such as poster board. In Western saddle classes, a card containing the exhibitor number is usually displayed on each side of the horse by attachment to the saddle pad or saddle blanket by pinning, such as by a tie-tack arrangement.

Contestants in English saddle classes, however, have traditionally worn their exhibitor numbers on their backs. Accordingly, the number is visible to the judge only when the horse and rider are viewed from the rear. This is not a problem in English classes such as dressage, working hunter, and open jumping, where each horse is exhibited and announced individually. However, there are English classes in which many horses compete at the same time. For example, in "hunter under saddle" classes, the horses entered in the class (or a split of the class) all show at the same time at specified gaits along the rail, in clockwise and counter clockwise directions.

The horses in hunter under saddle classes are judged mainly by their performance (e.g., movements, gaits and responsiveness to the rider); however, a minimum of 20 percent of the judging is based on the physical condition of the horse and the "conformation" of the horse (i.e., how closely the horse resembles an "ideal" prototype quarter horse in physical appearance, carriage, and the like), as well as the appearance of the horse and rider together. In this competition, the judge views each horse in profile from the center of the ring to observe its way of going (performance) and its condition and conformation. Because the exhibitor numbers are worn on the backs of the riders, the judge must look up at the rider's back while the horse is moving away in order to note the exhibitor number and mark his/her judging card. Glancing from horse to number to card and back again creates considerable difficulty for the judges in keeping track of all of the horses and numbers, especially when similarly colored horses ridden by similarly garbed riders move in and out along the rail. At horse shows with a large number of entries and substantial prize money at stake, the hunter under saddle class competition frequently runs overtime, causing disruption in the show schedule, as judges are continually required to re-identify horses they mentally selected but whose numbers they were unable to record before they moved out of view. The hunter under saddle class competition is known to generate the largest number of complaints to the show management about errors in judging.

In recognition of the above-described problem, judges have requested of the American Quarter Horse Association judging committee that exhibitors in hunter under saddle classes be required to display their number on each side of the horse. However, until the present time, the judging committee has declined to pass the rule because of their belief that no suitable method is available to display the numbers on the sides of the horse that would not detract from the overall appearance of the horse and impair the judging of conformation.

In view of the foregoing, there is a need for a method of displaying exhibitor numbers on each side of a horse, especially in the English hunter under saddle class competition, that does not detract from the appearance of the horse and rider.

SUMMARY OF THE INVENTION

The invention provides a saddle pad having a contour shape that conforms to the shape of an English saddle, except that the rear area of the saddle pad extends downward from the saddle contour shape and rearward from each side of the saddle contour shape to form a rear area on each side of the saddle pad that is sufficient in size to accommodate an exhibitor number that can be viewed on each side of a horse when the saddle pad is used with a saddle. In embodiments of the invention, the saddle pad can be contoured to conform to the shape of different types of English saddles that traditionally use contour pads for show purposes, such as those used for the hunter under saddle class, the English saddle seat class, and the like. Preferably, when conformation of the horse is considered in judging, the size of the rear area is the minimum size that can accommodate the exhibitor number such that it can be viewed (e.g., by a judge) on each side of a horse when the saddle pad is used with a saddle, without unnecessarily detracting from the appearance of the horse.

In some embodiments of the invention, a card printed with the exhibitor number may be attached directly to each side of the saddle pad in the rear area, such as by pinning (e.g., tie-tacking), glueing, stapling, and the like, preferably in a manner that secures at least the corners of the card to prevent any "flapping" of the card due to movement of the horse, a breeze, or the like, which could possibly distract or disturb the horse and affect its performance.

In a preferred embodiment of the invention, the rear area of the invention saddle pad further comprises a transparent or translucent, preferably non-glare plastic envelope-type pocket attached to the rear area on each side of the saddle pad, into which a card printed with the exhibitor number may be inserted (and removed). Such pockets may be attached to the saddle pad by tie-tacking, glueing, stapling, and the like, but are preferably attached by a hook and pile fastener arrangement, described further below. The pockets must be secured to the saddle pad in such a manner as to prevent flapping of the pocket and/or the card in the pocket, as described above, in order not to disturb the performance of the horse. The pocket is sufficient in size to securely contain the exhibitor number card.

A major benefit of the saddle pad of the invention is that the exhibitor's number can be displayed on each side of the horse and within the same field of vision in which the judge evaluates the movement and conformation of the horse, thereby eliminating the viewing problems described above associated with the wearing of the number on the rider's back. Moreover, the saddle pad of the invention assures that the exhibitor number is continuously available to the judge, regardless of the relative position of the contestant and the judge. Another benefit of the saddle pad of the invention is that exhibitor number is displayed without detracting from the presentation of the horse.

Yet another benefit of the preferred saddle pad of the invention is that an exhibitor number is easily insert into and removed from each of the pockets attached to the saddle pad. This feature affords more convenience to exhibitors (who are often hurriedly changing their attire to be on time for the next class) than current display methods that require fastening a number card to the back of the riding jacket (e.g.,by tie-tacking), tying a number card with string around the waist and wrapping the excess string around a jacket button, hooking the top of the number card by an attached wire hanger to a loop on the back of the collar and pinning the bottom of the card to the back of the jacket, and the like.

The contour saddle pad of the invention with display of the exhibitor number on each side of the pad may be used for all English classes, including classes in which horses show individually, such as the open jumping class, the dressage class, the working hunter class, and the English saddle seat class, but is particularly useful in the hunter under saddle class to aid judges in distinguishing between multiple competitors exhibiting at the same time.

DETAILED DESCRIPTION OF THE INVENTION

Saddle pads for use on horses are well known in the equestrian world. These pads are used to prevent chafing and scraping of the saddle against the body, and particularly the back of the horse. Saddle pads typically have an outer layer of a soft deep pile material which, when compressed with the weight of the saddle, will still provide airflow between the saddle and the pad. Suitable outer layers include lambs wool fleece, acrylics, polyesters, or blends, and the like. The inner layer of the saddle pad, which comes into contact with the horse's body, is usually a non-slip layer, often quilted, of cotton, flannel, wool, and the like. Saddle pads may additionally be designed to accommodate the insertion of various types of shock absorbing or other layers.

Generally, a saddle pad is selected to match the contour of the saddle to be used. Thus, for example, a pad for an English-type saddle would not be selected for use with a western-type saddle. Moreover, English saddles used for such classes as dressage, open jumping, hunter under saddle, English saddle seat, and the like, have different shapes. There are currently only two styles of English saddle pads in use, the contour pad and the square (or rectangular) pad.

Figure 1:
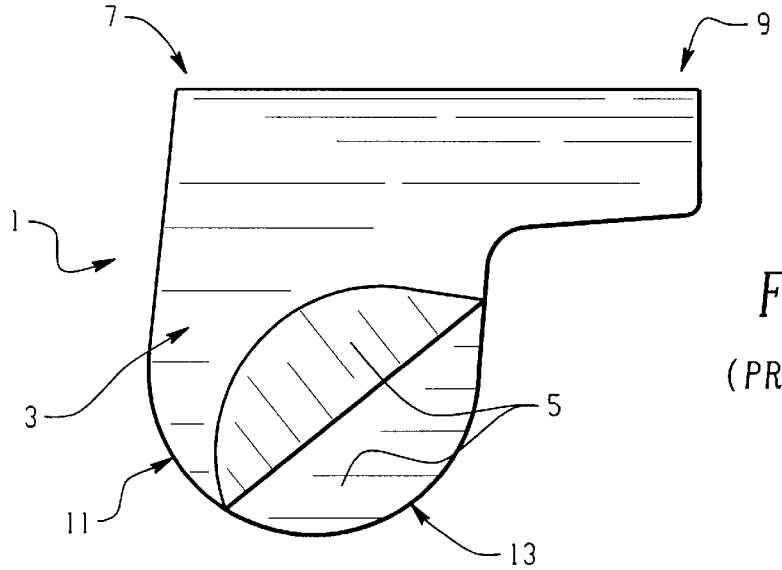
Fig. 1 (PRIOR ART)
FIG. 1 is a schematic profile view of a prior art contour saddle pad used with English saddles in classes in which conformation is a criteria in judging, with a portion of the saddle pad rolled back to illustrate the inner surface that contacts the horse when the entire pad is draped over the horse's back.
Figure 3:
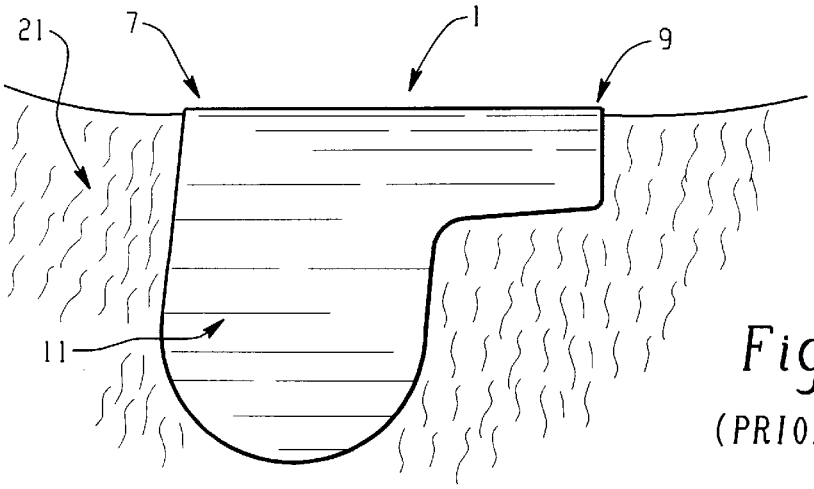
Fig. 3 (PRIOR ART)
FIG. 3 is a schematic profile view of a prior art contour saddle pad as it would generally appear when draped over the back of a horse.

A conventional contour style saddle pad 1, illustrated in profile in FIG. 1 and generally positioned on the back of a horse in FIG. 3, has an outer surface 3 and an inner surface 5 that makes contact with the horse. The saddle pad 1 further has a forward area 7, a rear area 9, and two side areas 11 and 13 that are on either side of the horse when the saddle pad is draped over the horse's back 21. Contour saddle pads are preferred for show use in classes such as the hunter under saddle class because these pads conform to the outline of the saddle and cover only the area necessary for the protection of the horse's back. They preserve, and do not detract from, the appearance of the horse. As discussed above, conformation counts for a significant percentage of the judging criteria in the hunter under saddle class. The contour style pad is also used for the English saddle seat class in which the saddle pad is hidden by the saddle and conformation is a judging criteria.

Figure 2:
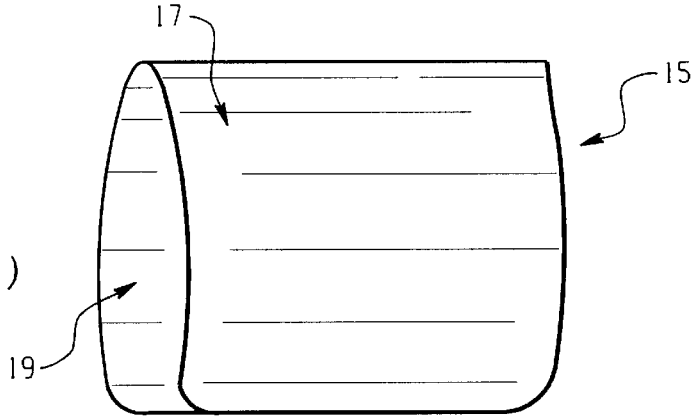
Fig. 2 (PRIOR ART)
FIG. 2 is a schematic profile view of a prior art square saddle pad traditionally used for schooling purposes or for show in classes such as open jumping or dressage, where conformation is not a criteria in judging.

The second style of pad, the square pad or "Olympic" pad, is illustrated in FIG. 2. This square pad 15 also has an outer surface 17 and an inner surface 19 that makes contact with the horse when it is draped over the horse's back. This pad is traditionally used for schooling purposes and for show in classes such as open jumping and dressage, where conformation is not a judged criteria. Although the square pad is large enough to display numbers, it is unsuitable for show use on horses in classes such as the hunter under saddle class in which conformation is a judging criteria because it covers a much larger area of the horse than does the contour pad and it diminishes the size and appearance of the horse. Moreover, this larger white pad extends well beyond the saddle contour, especially on the sides of the horse, and therefore it tends to distract the eye of the viewer from the conformation of the horse and rider. For example, the "drop", which is the distance from the portion of the saddle pad covering the horse's spine to the bottom of a side area, is usually about 18 to 20 inches for a square pad, but only about 13½ inches for a contour pad. Thus, the contour pad covers considerably less area than the square pad and is therefore considerably less distracting than the square pad.

Figure 4:
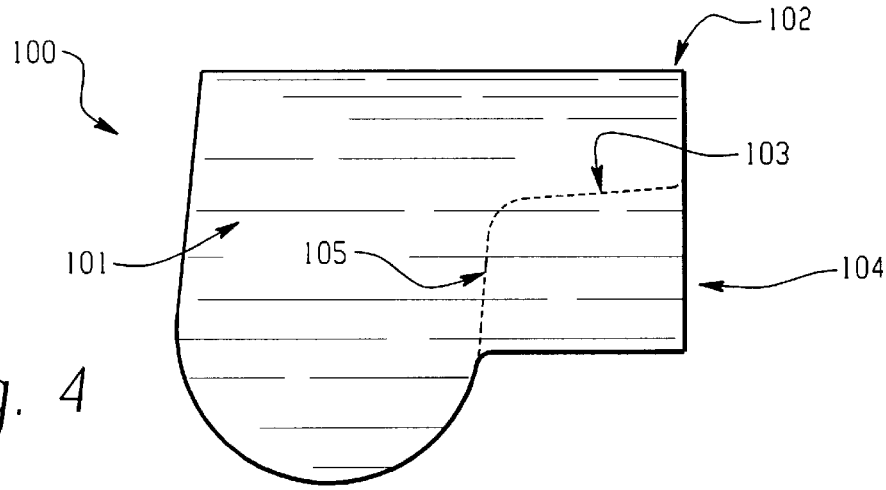
FIG. 4 is a schematic profile view of the contour saddle pad of the invention with a conventional contour pad superimposed thereon (dotted line).

The contour saddle pad 100 of the invention is illustrated in profile in FIG. 4 with the shape of a conventional contour pad 101 superimposed thereon (dotted line) for illustration purposes only. As can be seen from the Figure, the rear area 102 of the contour pad 100 does not conform to the rear profile of the conventional contour pad. Rather, in order to accommodate an exhibitor number, the rear area 104 of the saddle pad 100 extends downward from the saddle contour shape 103 and rearward from the side 105 of the saddle contour shape to form a rear area 104 sufficient in size, taking into consideration the contour of the back of the horse, to accommodate an exhibitor number that is placed in a position on each side of the pad such that it can be easily viewed (e.g., by a judge) on each side of a horse when the saddle pad is used with a saddle. Preferably, the size of the rear area 104 is the minimum size that can accommodate the exhibitor number on each side of the horse for viewing by the judge, in order to not unnecessarily detract from the appearance of the horse and rider.

An exhibitor number is typically printed on or otherwise attached to a heavy paper or cardboard, such as poster board. The card having the exhibitor number may then be attached to the saddle pad in the rear area 104 by various means including, but not limited to, pinning (e.g., tie-tacking), glueing, stapling, and the like. It is important that the exhibitor number card be securely attached to the saddle pad, preferably in a manner that secures at least the corners of the card, to prevent any "flapping" of the card due to movement of the horse, a breeze, or the like, which could possibly distract or disturb the horse and affect its performance.

Figure 5:
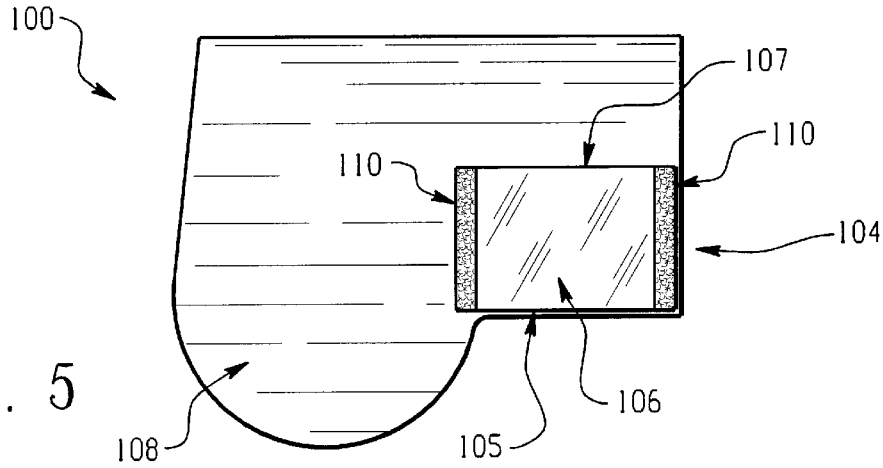
FIG. 5 is a schematic profile view of a preferred embodiment of the saddle pad of the invention having a pocket attached to the rear area for receiving a card with an exhibitor number.

In a preferred embodiment, illustrated in FIG. 5, a transparent or translucent, preferably non-glare plastic pocket 106 is removably attached to an outer surface 108 of the rear area 104 of the saddle pad 100 for displaying an exhibitor number. The preferred pocket has two layers (not shown), a front layer and a back layer, that form an envelope shape having a closed bottom 105 and an open top 107 into which the exhibitor number card may be easily inserted (or removed). The pocket provides a stable container for the exhibitor number card and eliminates any potential problem of loosening or flapping of the card.

The outer surface of the back layer of the pocket may be attached to the outer surface 108 of the rear area 104 of the saddle pad 100 by any method, including pinning (e.g., tie-tacking the corners), glueing, stapling, and the like, that does not interfere with the insertion of the exhibitor number card into the pocket. The pocket is secured to the saddle pad in any manner that prevents any flapping of the pocket and/or the card due to movement of the horse, a breeze, or the like, which could possibly distract or disturb the horse and affect its performance. Preferably, the back layer of the pocket is attached to the saddle pad by means of hook and pile fibrous fasteners 110. Hook and pile fasteners 110 suitable for attaching a pocket 106 to an outer surface 108 of the saddle pad 100 are well known and are widely available under the Velcro® trademark. Such fasteners comprise two attaching strips, one of stiff fibers resembling a carpet and the other a strip comprising a large plurality of hook-shaped fibers, one strip being attached to the outer surface of the saddle pad, and one strip being attached to a portion of the outer surface of the back layer of the pocket (not shown). These strips mate together firmly but are not inseparably engaged upon being pressed together. Disengagement is effected by a hand peeling force. The removability of the plastic pocket from the saddle pad in the preferred embodiment of the invention provides an advantage in that it can be removed prior to laundering the saddle pad.

In another embodiment (not shown) of the invention, a single layer of plastic may be attached to the outer surface of the saddle pad, by any of the means described above, for containing the exhibitor number card. The layer may be attached to the saddle pad at its sides and bottom, forming a closed "pocket" between the outer surface of the saddle pad and the inner surface of the plastic layer to contain the card. Again the attachment must be such that any flapping of the card or plastic is prevented. This single layer of plastic embodiment, however, is less preferred than the envelope pocket for facilitating easy insertion and removal of the card.

Figure 6:
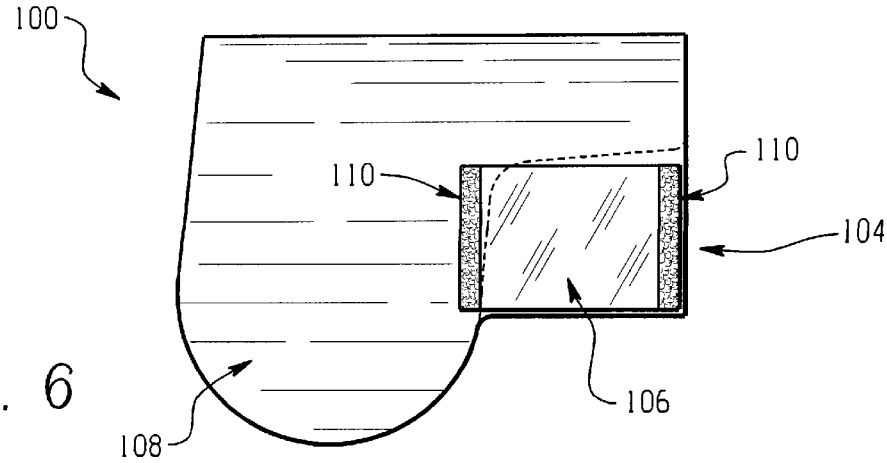
FIG. 6 is a schematic profile view of the saddle pad of FIG. 5, showing the minimum area of the rear of the saddle pad for containing the pocket and exhibitor number. A conventional contour pad is superimposed thereon (dotted line).

In a more preferred embodiment of the saddle pad of the invention, illustrated in FIG. 6, the rear area 104 of the saddle pad 100 has a dimensional area that is the minimum area that can accommodate the exhibitor number and that, taking into consideration the curve of the horse's back, can be viewed on each side of a horse when the saddle pad is used with a saddle without unnecessarily detracting from the appearance of the horse. In this Figure, the contour of a prior art saddle pad 103 is superimposed (dotted line) for illustration purposes only.

Figure 7:
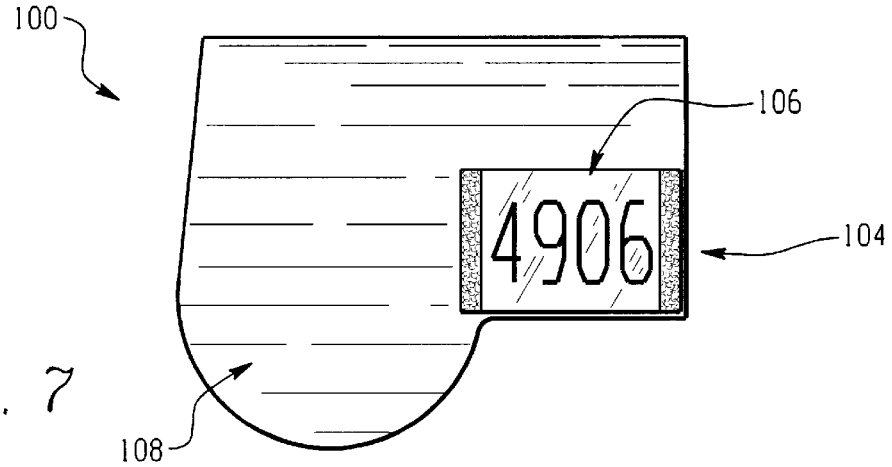
FIG. 7 is a schematic profile view of the saddle pad of FIG. 5, showing a card with an exhibitor number inserted in the pocket.

As illustrated in FIG. 7, a card containing the exhibitor number may then be conveniently inserted into the pocket for display purposes, and easily removed from the pocket when the class has ended.

Figure 8:
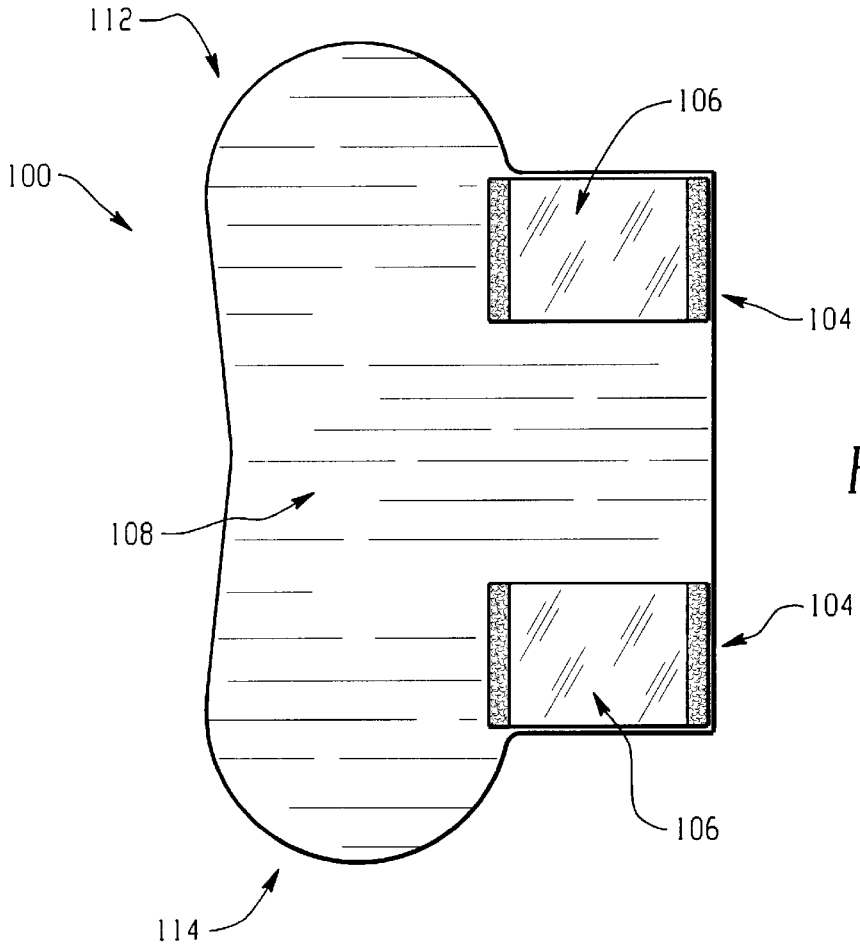
FIG. 8 is a top view of the saddle pad of the invention as it appears opened up to place on a horse. The Figure further illustrates a pocket for containing the exhibitor number each side of the saddle pad.

FIG. 8 illustrates a top view of an entire saddle pad 100 of the invention showing each of two pockets 106 attached to the outer surface 108 of the rear area 104 on each side 112 and 114 of the saddle pad 100.

Figure 9:
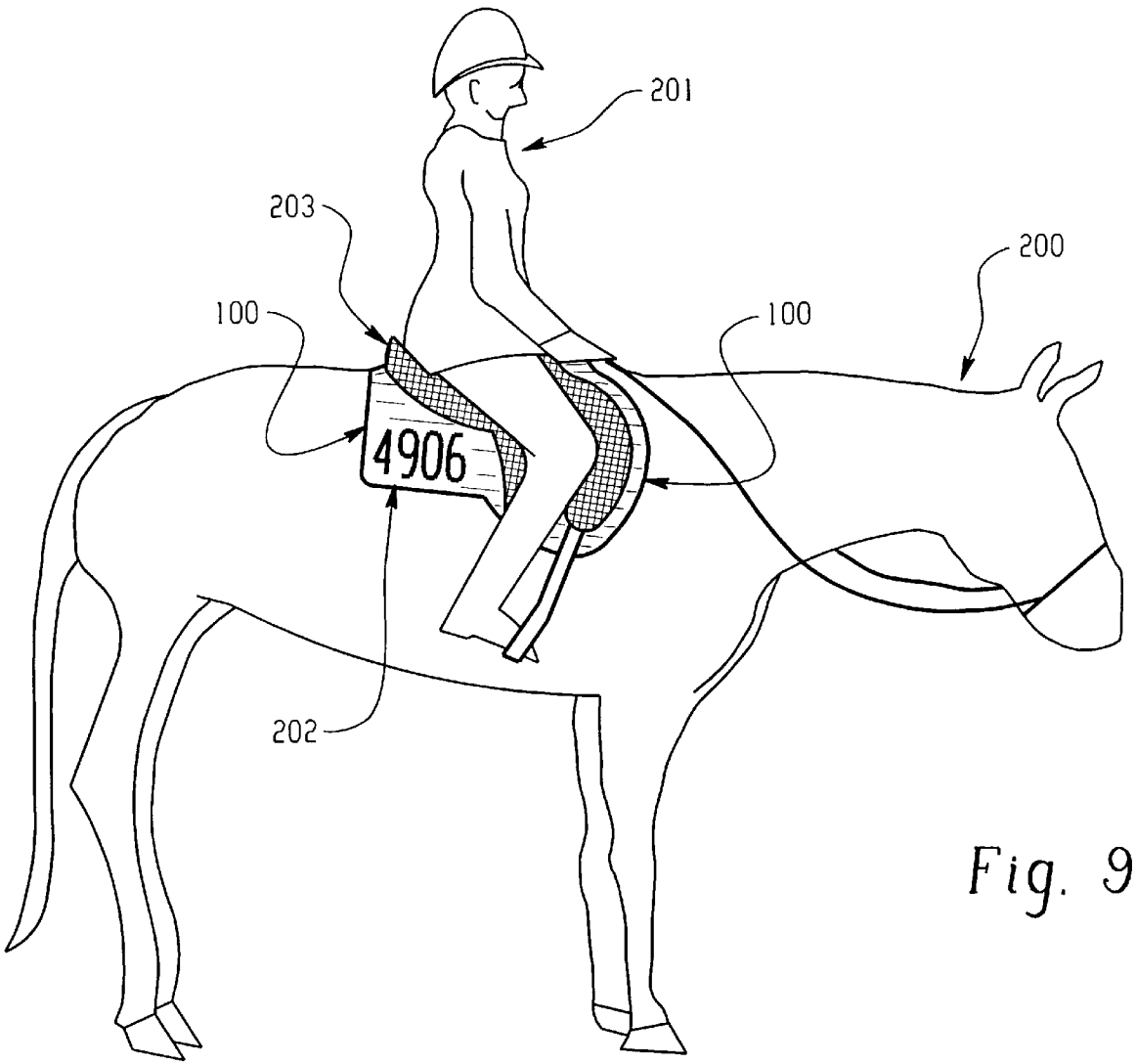
FIG. 9 is a schematic view of a horse and rider, saddle, and the saddle pad of the invention displaying an exhibitor number. The exhibitor number is also displayed on the saddle pad on the other side of the horse (not shown).

FIG. 9 illustrates a saddle pad 100 of the invention as it appears with a horse 200 and rider 201 under a saddle 203 (hatched lines), and having an exhibitor number 202 appearing on the side of the horse. An identical exhibitor number appears on the other side of the horse (not shown).

While the invention has been described herein with reference to the preferred embodiments, it is to be understood that it is not intended to limit the invention to the specific forms disclosed. On the contrary, it is intended to cover all modifications and alternative forms falling within the spirit and scope of the invention.

I claim:

1. A saddle pad having a contour shape that conforms to the shape of an English saddle, said pad further having a rear area that extends downward from the saddle contour shape and rearward from each side of the saddle contour shape to form a rear area on each side of the saddle pad that is sufficient in size to accommodate an exhibitor number that can be viewed on each side of a horse when the saddle pad is used with a saddle.

2. The saddle pad of claim 1, wherein the size of the rear area is the minimum size that accommodates the exhibitor number.

3. The saddle pad of claim 1, wherein the English saddle is a saddle used in the hunter under saddle class or the English saddle seat class.

4. The saddle pad of claim 1, further comprising a pocket attached to an outer surface of said rear area, wherein the pocket is configured to contain and display a card having the exhibitor number printed thereon.

5. The saddle pad of claim 4, wherein the pocket has a front layer and a back layer and a closed bottom and an open top and the pocket forms an envelope that is sufficient in size to securely contain the card having the exhibitor number printed thereon.

6. The saddle pad of claim 5, wherein the back layer of the pocket is attached to the outer surface by means of a hook and pile fastener.

7. The saddle pad of claim 4, wherein the pocket comprises transparent or translucent plastic.

8. The saddle pad of claim 7, wherein the pocket comprises a non-glare plastic.

9. The saddle pad of claim 1, wherein the exhibitor number is securely pinned, glued or stapled directly to the saddle pad.

* * * * *